US009777533B2

(12) United States Patent
Lindgren et al.

(10) Patent No.: US 9,777,533 B2
(45) Date of Patent: Oct. 3, 2017

(54) WINDOW ARRANGEMENT COMPRISING A PLURALITY OF WINDOW SYSTEMS AND AT LEAST ONE ACCESSORY ELEMENT

(71) Applicant: VKR Holding A/S, Hørsholm (DK)

(72) Inventors: Claes Lindgren, Farum (DK); Brent Møller, Gentofte (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 14/898,146

(22) PCT Filed: Jun. 19, 2014

(86) PCT No.: PCT/DK2014/050179
§ 371 (c)(1),
(2) Date: Dec. 14, 2015

(87) PCT Pub. No.: WO2014/202095
PCT Pub. Date: Dec. 24, 2014

(65) Prior Publication Data

US 2016/0145936 A1 May 26, 2016

(30) Foreign Application Priority Data

Jun. 21, 2013 (DK) ..... 2013 70339

(51) Int. Cl.
*E06B 7/28* (2006.01)
*E04D 13/03* (2006.01)
(Continued)

(52) U.S. Cl.
CPC ..... *E06B 7/28* (2013.01); *E04D 13/031* (2013.01); *E06B 3/26* (2013.01); *E06B 3/549* (2013.01)

(58) Field of Classification Search
CPC . E04B 19/006; E04B 2/96; E06B 7/28; E06B 3/26; E06B 3/549; E06B 3/66376; E04D 13/031
(Continued)

(56) References Cited

U.S. PATENT DOCUMENTS 2,175,653 A * 10/1939 Williams ..... E04D 3/08 52/277
2,345,650 A * 4/1944 Attwood ..... B62D 33/044 211/182
(Continued)

FOREIGN PATENT DOCUMENTS

DE 202007001073 5/2008
DE 202009011383 5/2010
(Continued)

OTHER PUBLICATIONS

Machine translation of foreign reference EP0627532A1, obtained from https://patentscope.wipo.int/search/en/detail.jsf?docId=EP12559334&recNum=1&maxRec=&office=&prevFilter=&sortOption=&queryString=&tab=PCTDescription (last viewed on Mar. 28, 2017).*
(Continued)

*Primary Examiner* — Theodore Adamos
(74) *Attorney, Agent, or Firm* — Merek, Blackmon & Voorhees, LLC

(57) ABSTRACT

The window arrangement comprises a plurality of neighboring window systems, each window system comprising a frame structure (1, 101) including a plurality of frame members including a pair of opposed side frame members (3, 105), and at least one accessory element (200). Each side frame member comprises a groove such that two grooves of juxtaposed side frame members of two neighboring window systems form a track (100). The accessory element or
(Continued)

elements (200) is connected to the window systems by means of the track.

13 Claims, 11 Drawing Sheets

(51) Int. Cl.
*E06B 3/26* (2006.01)
*E06B 3/54* (2006.01)

(58) Field of Classification Search
USPC ..... 52/27, 204.5, 235; 403/179, 326, 330; 362/145, 147, 148, 150, 151
See application file for complete search history.

(56) References Cited

U.S. PATENT DOCUMENTS 3,081,849 A * 3/1963 Hubbard ..... E04B 2/96 49/413
4,531,336 A * 7/1985 Gartner ..... E04B 2/90 49/DIG. 1
4,765,102 A * 8/1988 Kuchem ..... E04B 1/0046 362/147
4,809,475 A * 3/1989 Emmer ..... E06B 3/5427 52/204.591
4,819,549 A * 4/1989 Gillingham ..... B01D 46/0002 403/265
4,883,513 A * 11/1989 Monson ..... F24F 13/28 52/144
5,279,090 A * 1/1994 Yamaguchi ..... E04B 9/02 454/187
5,435,106 A * 7/1995 Garries ..... E06B 1/36 49/DIG. 2
7,162,842 B2 * 1/2007 Ribic ..... E06B 3/5427 52/167.3
8,720,134 B2 5/2014 Lindgren et al.
9,038,344 B2 * 5/2015 Mayer ..... F21V 33/006 52/220.6
9,140,050 B2 9/2015 Lindgren et al.
2002/0092248 A1 * 7/2002 Westphal ..... E06B 1/6007 52/204.5
2011/0094065 A1 * 4/2011 Frederick ..... E06B 9/326 24/115 F
2011/0113706 A1 * 5/2011 Krause ..... F41H 5/263 52/204.5
2012/0167496 A1 * 7/2012 Lindgren ..... E04D 13/031 52/204.1
2013/0047541 A1 * 2/2013 Mayer ..... E04B 9/366 52/506.05
2013/0186031 A1 * 7/2013 Ting ..... E04B 1/40 52/698

FOREIGN PATENT DOCUMENTS

EP 0627532 A1 * 12/1994 ..... E04B 9/006
EP 1443169 8/2004
EP 2000623 12/2008
EP 2472026 7/2012
GB 940352 10/1963
GB 2386636 9/2003

OTHER PUBLICATIONS

Search Report dated Feb. 4, 2014 conducted by Danish Patent and Trademark Office, 5 pages.

* cited by examiner

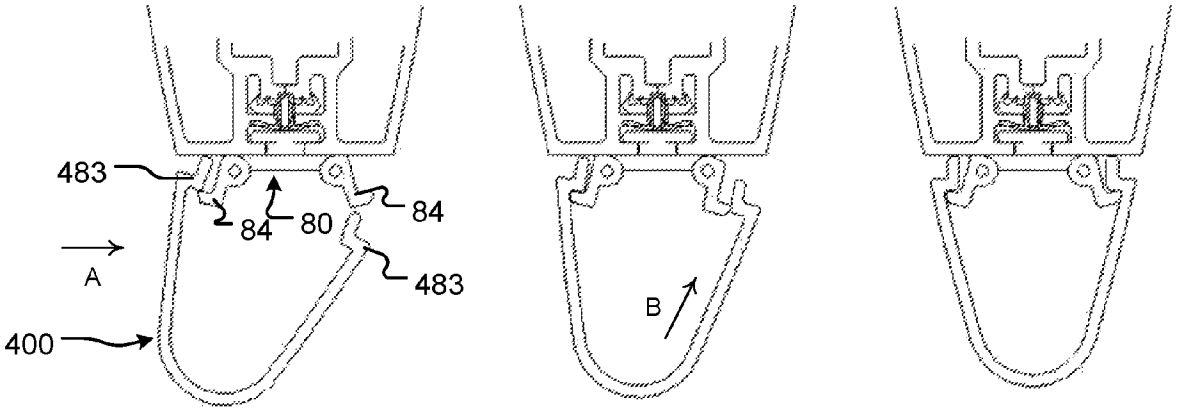
Fig. 12a
Fig. 12b
Fig. 12c
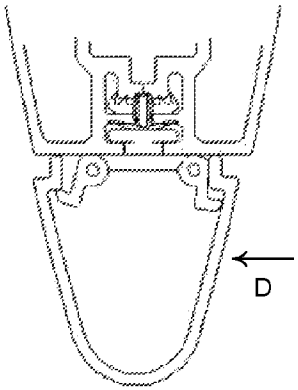
Fig. 12d
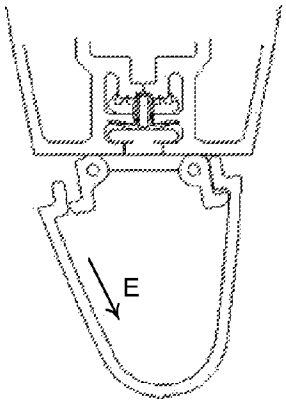
Fig. 12e

WINDOW ARRANGEMENT COMPRISING A PLURALITY OF WINDOW SYSTEMS AND AT LEAST ONE ACCESSORY ELEMENT

The present application is a 371 application of International Application No. PCT/DK2014/050179 filed on Jun. 19, 2014 which claims priority from foreign application No. PA 2013 70339 filed in Denmark on Jun. 21, 2013.

The invention relates to a window arrangement comprising a plurality of neighbouring window systems, each window system comprising at least a frame structure including a plurality of frame members including a pair of opposed side frame members, and at least one accessory element.

The resources spent on designing and constructing such a window arrangement are typically substantial. However, installation elements necessary to ensure safe and comfortable operation of the buildings must be present in any building, and it is thus necessary to mount elements such as smoke sensors, sprinkler units, temperature sensors etc. near the ceiling of the room, in which the window arrangement is installed. As such window arrangements often also form a substantial part of the roof and ceiling of a building, it is a challenge to mount such installation elements near or at the window arrangement without compromising the appearance and functioning of the window arrangement.

With this background it is an object of the present invention to provide a window arrangement comprising a plurality of window systems and at least one accessory element in a manner that is reliable and flexible, but yet fulfills the requirements to design and operation.

This object is achieved by a window of the kind mentioned in the introduction, which is furthermore characterized in that each side frame member of said pair of opposed side frame members comprises at least one groove such that two grooves of juxtaposed side frame members of two neighbouring window systems form a track, and that the at least one accessory element is connected to the window systems by means of said track.

By forming a track by two grooves facing each other, a simple and reliable solution is provided. The frame structures of the neighbouring window systems may be provided with the respective groove at the manufacture of the window system without much additional expense, and a track suitable for accommodation of further elements thus arises when mounting the two neighbouring window systems side-by-side.

In a preferred embodiment, each window system furthermore comprises a sash structure carrying a pane element and including a plurality of sash members, and wherein the at least one groove of each side frame member is provided in a face of the side frame member facing away from the pane element. This provides for a particularly inconspicuous arrangement of the track and thus of the connection to the accessory element or elements.

Specifically, the at least one groove of each side frame member may be formed by a first protruding flange portion extending into a free edge, a second flange portion and a bridging portion between the first and the second flange portions. In a further development of this embodiment, which provides for a mechanically simple design and particularly reliable transfer of the load, a first distance between the free edges of the first protruding flange portions of juxtaposed side frame members lies in the range 5 to 30 mm, and a second distance between the bridging portions of juxtaposed side frame members lies in the range 10 to 50 mm, the second distance exceeding the first distance by at least 5 mm.

The connection between the at least one accessory element and the window systems is preferably provided by means of a connecting device, which renders the choice of form of the accessory element itself more flexible.

The connecting device may either be a separate element adapted to be received in the track and connected to the at least one accessory element, or integrated with the accessory element.

The connecting device may take a simple form such as a T-shaped or needle-shaped element, but in an embodiment which provides for a particularly flexible design, the connecting device comprises a plate portion and a protruding engagement portion having a first dimension not exceeding the first distance and a second dimension exceeding the first distance but not exceeding the second distance.

In a further development of the above-mentioned preferred embodiment, and which is particularly easy to install, after-mount and exchange, the plate portion is provided with a set of spring-biased hook elements.

It is also preferred that each accessory element comprises engagement means to engage with the track and/or the connecting device.

Preferably, the engagement between the accessory element and the track and/or the connecting device is releasable.

The accessory element may in principle be any element that is suitable or desirable for mounting in a building, but is preferably selected from the group: blind profiles, profiles comprising smoke sensors, profiles comprising lighting elements, profiles comprising ventilation devices, profiles comprising temperature measurement or regulating means, profiles comprising moisture measurement or regulating means, lighting devices, textile elements and baffle elements, including baffle elements having noise reducing properties.

A particularly harmonic and pleasant appearance of the window arrangement is obtained in an embodiment, in which each accessory element of the window arrangement comprises a uniform profile shape, and wherein a functionality is built into at least some of the accessory elements.

It is noted that even though the invention is described with reference to window arrangements including only windows, such an arrangement may also include further building elements, such as solar collectors. Such further building elements may also be provided with grooves similar to those in the window frames to allow the formation of tracks as described above. It is also possible to provide end elements having similar grooves and which may be arranged adjacent to the frame of the last window in the arrangement, so that a track is formed between the window frame and the end element.

Further details are described, and further advantages stated, in the description of particular embodiments of the invention.

In the following the invention will be described in further detail by means of examples of embodiments with reference to the schematic drawings, in which FIG. 1*a* is a perspective view of a detail of a window arrangement in an embodiment of the invention;

FIG. 1*b* is a perspective view of another detail of a window arrangement in an embodiment of the invention;

Figure 7A:
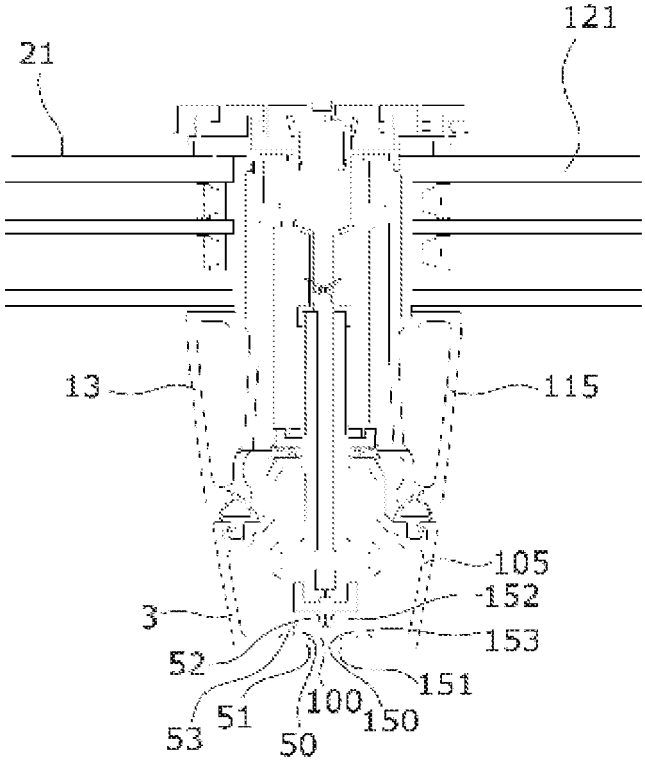
Figure 7B:
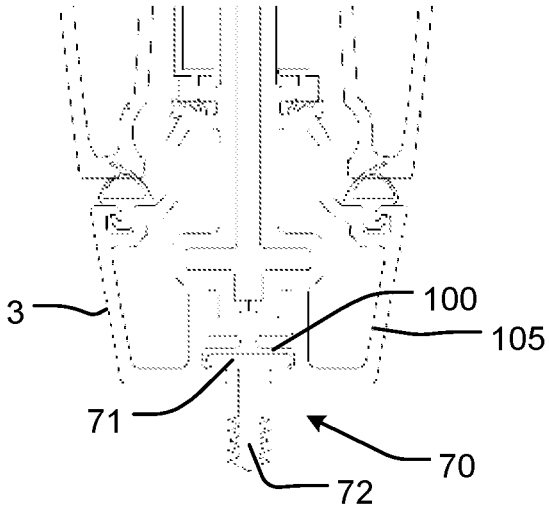
Figure 8A:
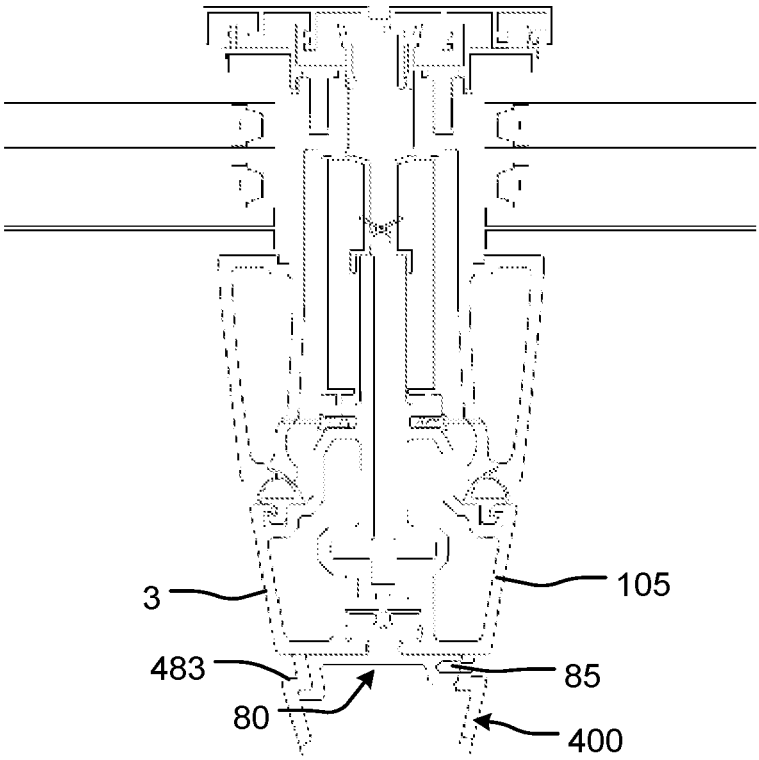
Figure 8B:
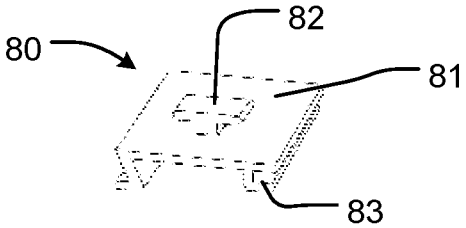

FIG. 7*a* is a cross-sectional view of an embodiment of the window arrangement according to the invention;

FIG. 7*b* is a cross-sectional partial view of details of an embodiment of the window arrangement;

FIG. 8*a* is a view corresponding to FIG. 7 of details of another embodiment of the window arrangement;

FIG. 8*b* is a partial perspective view of one detail of the embodiment of FIG. 8*a;*

Figure 9:
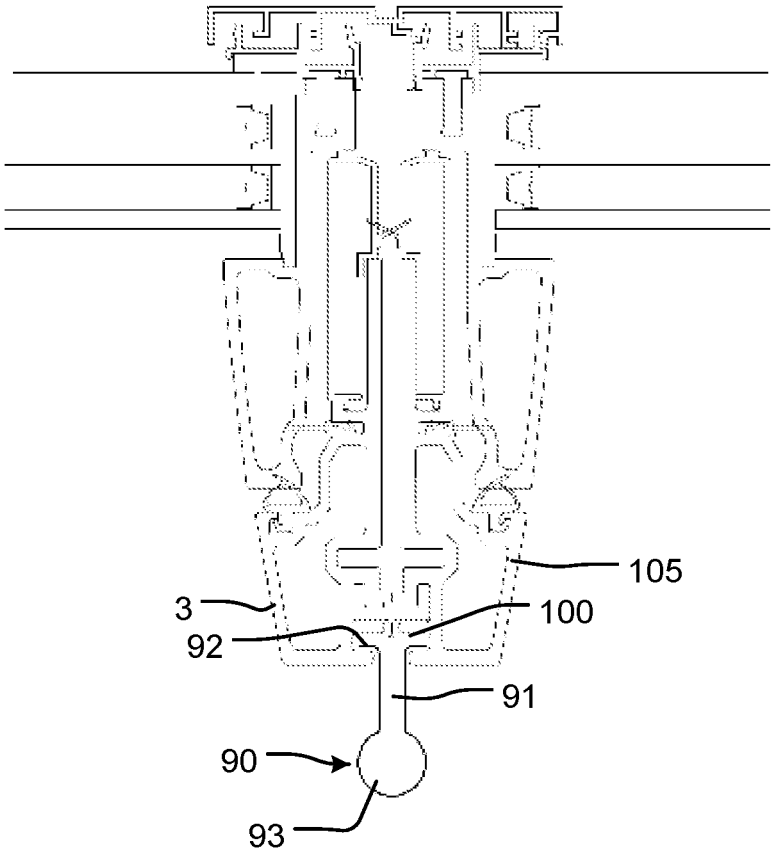
Figure 11:
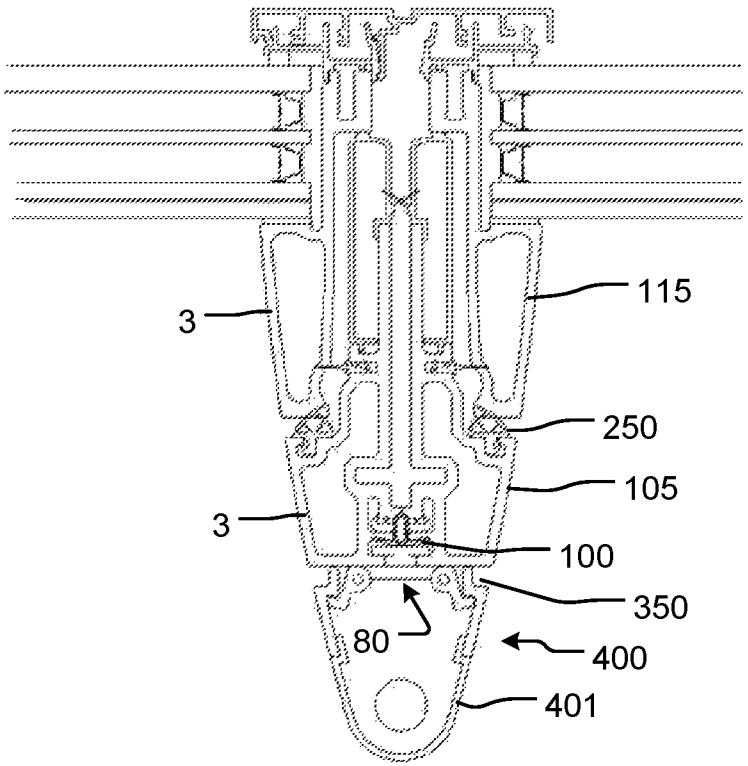
Figure 10:
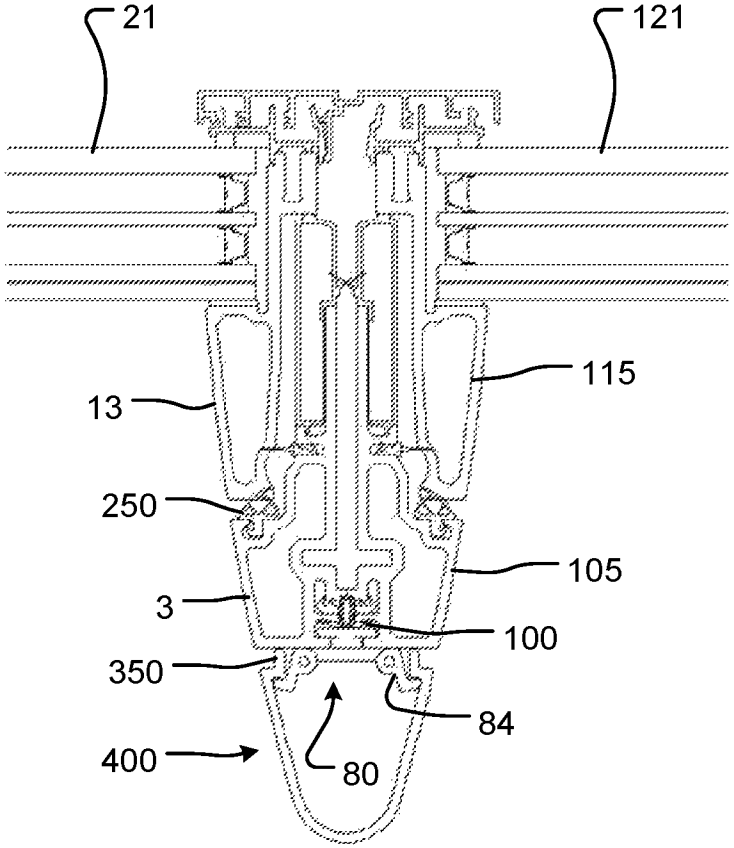

FIG. 9 is a view corresponding to FIG. 7 of details of another embodiment of the window arrangement;

FIG. 10 is a view corresponding to FIG. 7 of yet another embodiment of the window arrangement;

FIG. 11 is a view corresponding to FIG. 10 of a slightly different embodiment of the window arrangement; and FIGS. 12*a* to 12*e* are views showing a manner of handling the window arrangement in the embodiment of FIG. 10.

Referring now in particular to FIGS. 1 to 6, two frame structures 1 and 101 of a window arrangement according to the invention are shown in part. The respective frame structure 1 and 101 each form part of a respective window system of a plurality of neighbouring window systems, such as two, eight, 10, 20 or even more, mounted side by side. The window arrangement according to the invention may form many different geometrical configurations, e.g. an array of long lights forming a light band, and ridges, in which a second array of a corresponding number of window systems are mounted opposite the window systems of a first array.

In general, elements referring to the one window system 1 to the left will be denoted by reference numerals such as 1, 3 . . . and similar or corresponding elements of the window system to the right will be denoted by the same reference numerals to which 100 has been added.

The window system comprising a respective frame structure 1, 101 may for instance be formed as in Applicant's European patent application No. EP10197251.1, the contents of which are incorporated herein by reference.

Figure 1A:
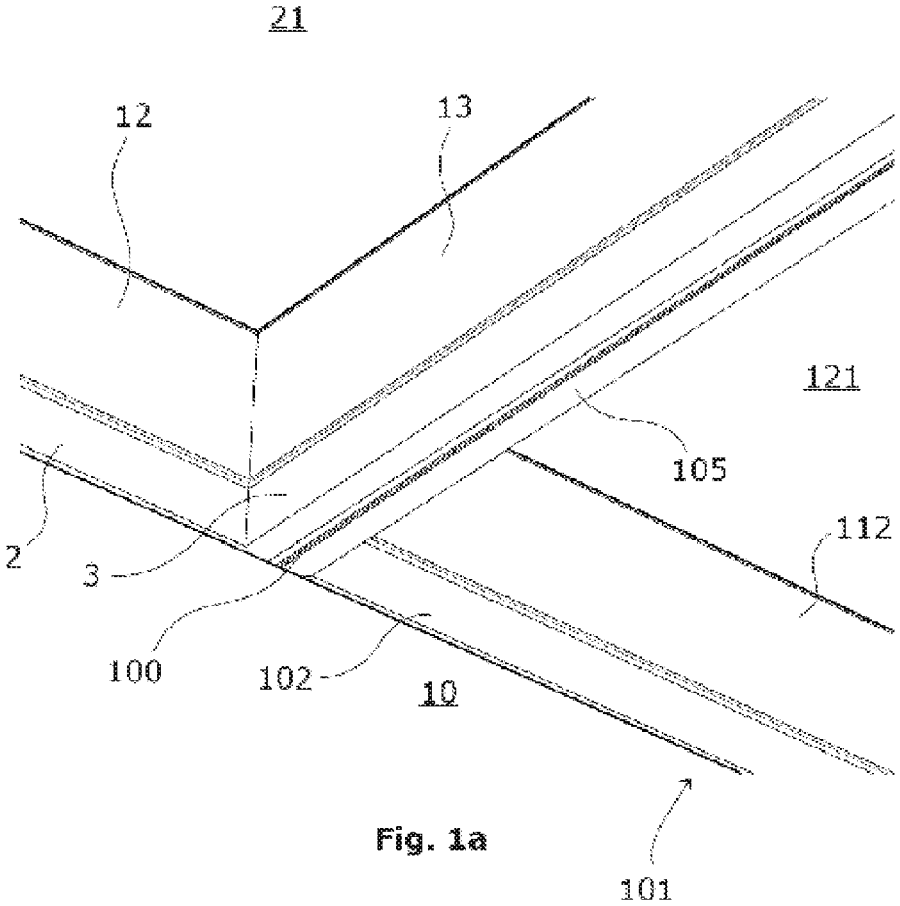

With particular reference to FIG. 1*a*, each window system thus comprises at least a frame structure 1, 101 including a plurality of frame members including a pair of opposed side frame members of which the right-hand side frame member 3 of the left-hand window system, and the left-hand side frame member 105 of the right-hand window system are visible in FIG. 1*a*. Furthermore, the bottom frame member 2, 102 of each frame structure 1, 101 are shown in FIG. 1*a*. The individual configuration of each window system of the embodiment shown will be described in some detail further down. In this description, terms such as "lower", "upper", "left-hand", "right-hand", "side", "top", "bottom", etc. refer to the shown position of the window system only, and is not to be interpreted as limiting the window system to use in a particular position only.

In the embodiment shown, each window system furthermore comprises a sash structure carrying a pane element 21, 121 and including a plurality of sash members, of which the bottom sash members 12, 112 are shown as well as the right-hand side sash member 13 of the left-hand window system (juxtaposed to the non-visible left-hand side sash member 115 of the right-hand window system represented by its frame structure 101, cf. FIG. 7*a*). Furthermore, at the lower end of the frame structures 1, 101 of the window systems a lining 10 is shown, the lining 10 functioning to cover the transition between the window systems and the supporting roof structure.

As will be described in further detail below, each side frame member 3, 105 of said pair of opposed side frame members comprises at least one groove such that two grooves of juxtaposed side frame members of two neighbouring window systems form a track 100.

Figure 1B:
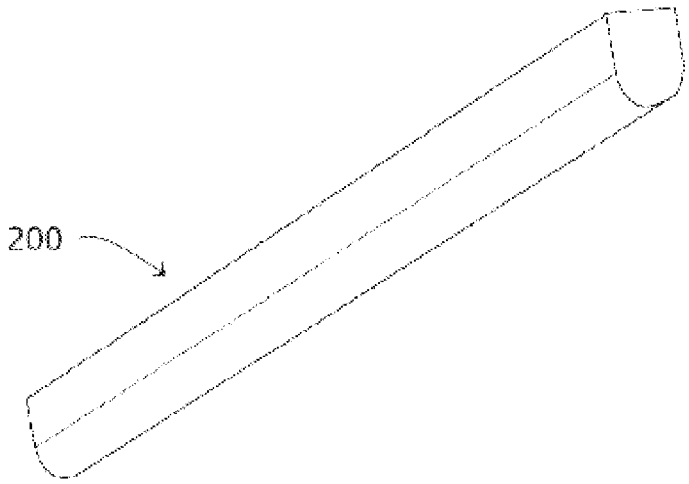

The track 100 is adapted to provide a connection to at least one accessory element 200, for instance as shown in FIG. 1*b*, thus connecting one or more accessory elements to the window systems by means of said track.

Such accessory element or elements are typically devices that are to be mounted in any ceiling, i.e. smoke sensors, sprinkler systems etc., but the track may also be used for connecting any accessory element, for instance selected from the group: blind profiles, profiles comprising smoke sensors, profiles comprising lighting elements, profiles comprising ventilation devices, profiles comprising temperature measurement or regulating means, profiles comprising moisture measurement or regulating means, lighting devices, textile elements and baffle elements, including baffle elements having noise reducing properties.

Referring now to FIGS. 2 to 6, each of these Figures shows an example of an accessory element to be connected to the track 100 formed by the window systems in a manner described in further detail below. Although only one accessory element or a limited number of accessory elements are shown in connection with each track, several accessory elements may be connected to one and the same track formed between neighbouring window systems. Typically, in the case of several accessory elements, they are connected in extension of each other in the longitudinal direction of the track. It may however also be considered to include accessory elements in parallel with each other. Furthermore, in all of the Figures, only two neighbouring window systems are shown, but as described in the above, a plurality of for instance eight, 10, 20 or even more window systems mounted side by side may be provided, possibly supplemented by an opposite array of window systems to provide a ridge configuration. In such larger window arrangements, all or only some of the neighbouring window systems may be provided with accessory elements, just as the form of the accessory elements may be varied as desired. For instance, a single design line may be chosen, for instance in the form of a particular uniform profile shape, and the functionalities desired may be built into the profile chosen. In order to secure a harmonic appearance, the respective track between window systems to which no functionality is assigned may be connected to profiles not having a particular functionality, such as a blind or dummy profile, designed to provide an aesthetically pleasant appearance, but also to close off the track.

Figure 2:
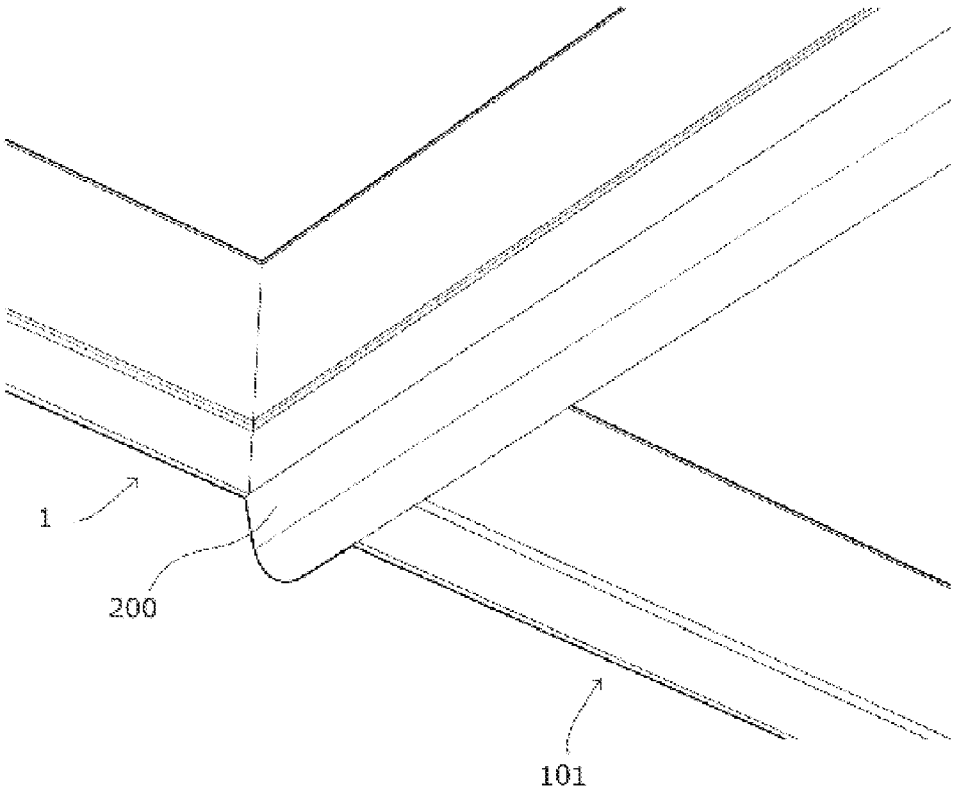
FIG. 2 is a perspective view of the window arrangement in the embodiment shown in FIGS. 1*a* and 1*b;*

Thus, the accessory element 200 shown in FIG. 1*b* and in its mounted position in FIG. 2 is a blind profile. The neighbouring window systems represented by the respective frame structure 1, 101 may either form part of a larger window arrangement comprising more than the two shown window systems, having possibly other accessory elements. In the preferred case, the engagement between the accessory element and the track (possibly via a connecting device, as will be described below) is releasable to facilitate exchange and/or maintenance. To this end, each accessory element comprises engagement means to engage with the track and/or the connecting device in the embodiments shown and described.

Figure 3:
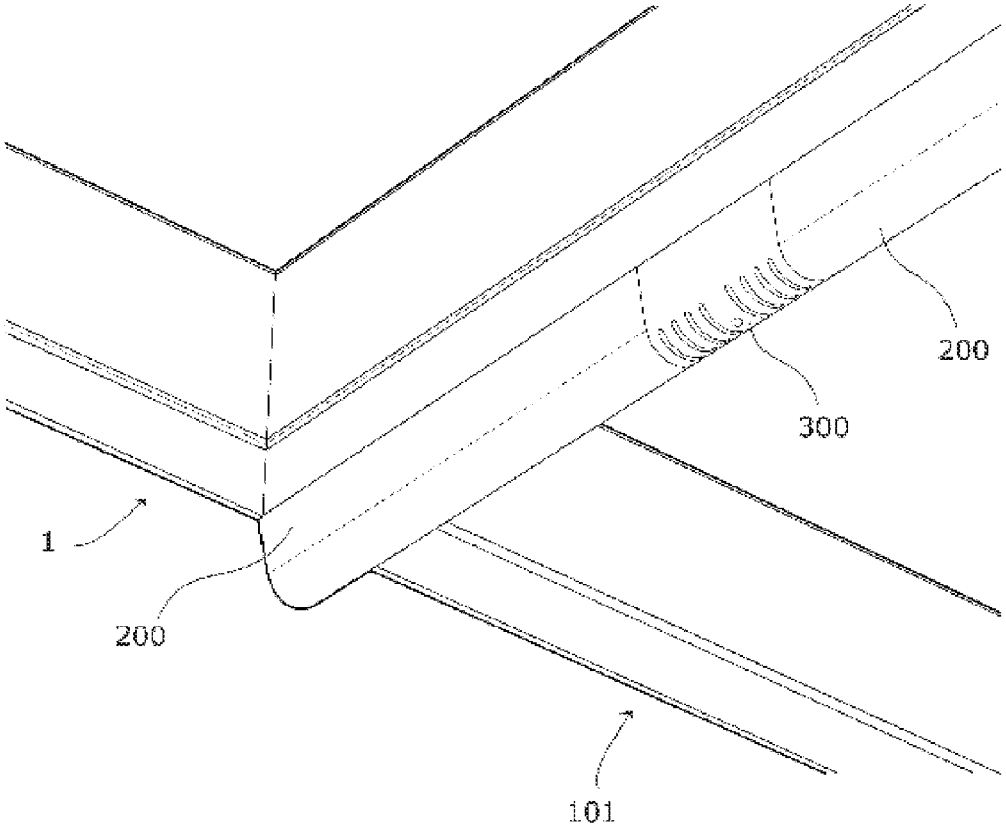
FIG. 3 is a view corresponding to FIG. 2, of another embodiment of the window arrangement according to the invention.
Figure 4:
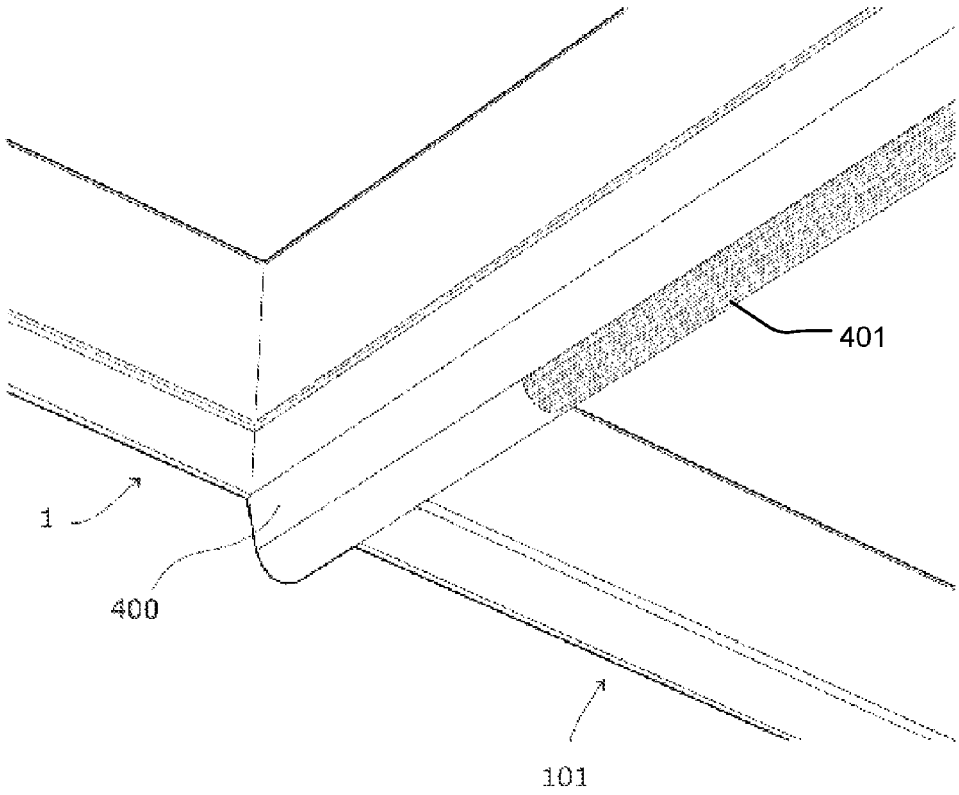
FIG. 4 is a view corresponding to FIG. 2, of a further embodiment of the window arrangement according to the invention.

FIGS. 3 and 4 show accessory elements 300 and 400, into which a functionality has been built in. The accessory element 300 is in the embodiment shown designed as a profile having the same shape as the blind profiles 200 mounted on either longitudinal side, and may for instance comprise a smoke sensor. The accessory element 400 is formed as a coherent profile to supplement or replace a blind profile and comprises a lighting device, i.e. a light source not shown, for instance in the form of a LED or a traditional fluorescent tube, covered by a transparent section 401.

Figure 5:
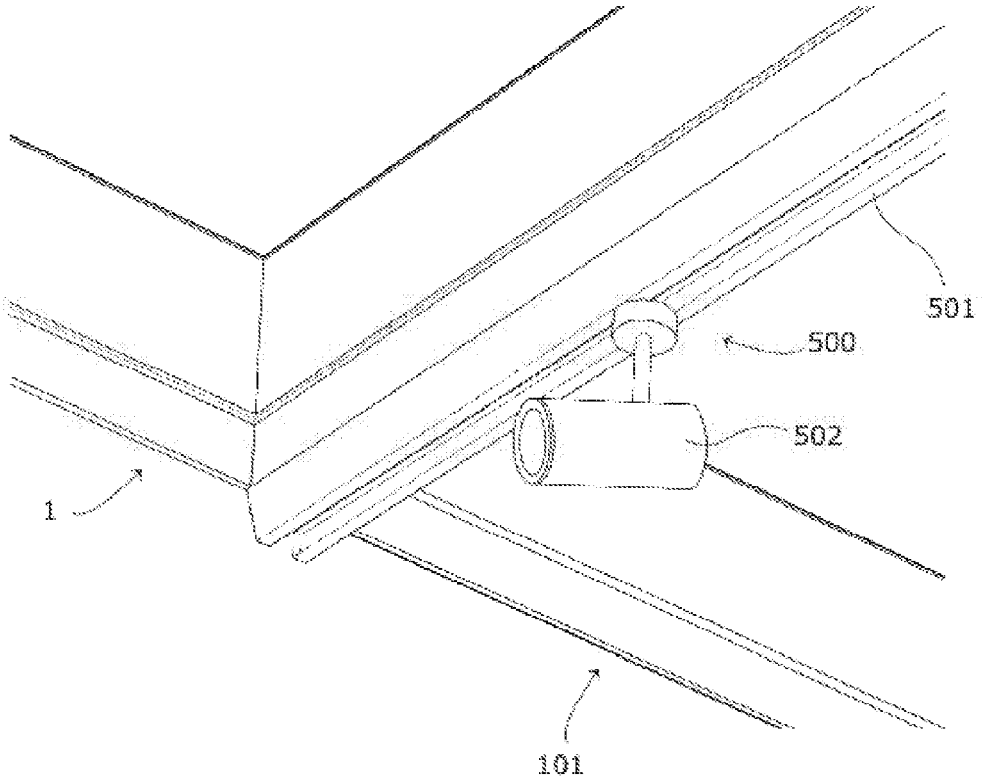
FIG. 5 is a view corresponding to FIG. 2, of a still further embodiment of the window arrangement according to the invention.

In the embodiment of FIG. 5, it is shown how the track between neighbouring window systems represented by the respective frame structures 1, 101 may be used to accommodate an accessory element 500 in the form of a rail 501 with a number of spots 502.

Figure 6:
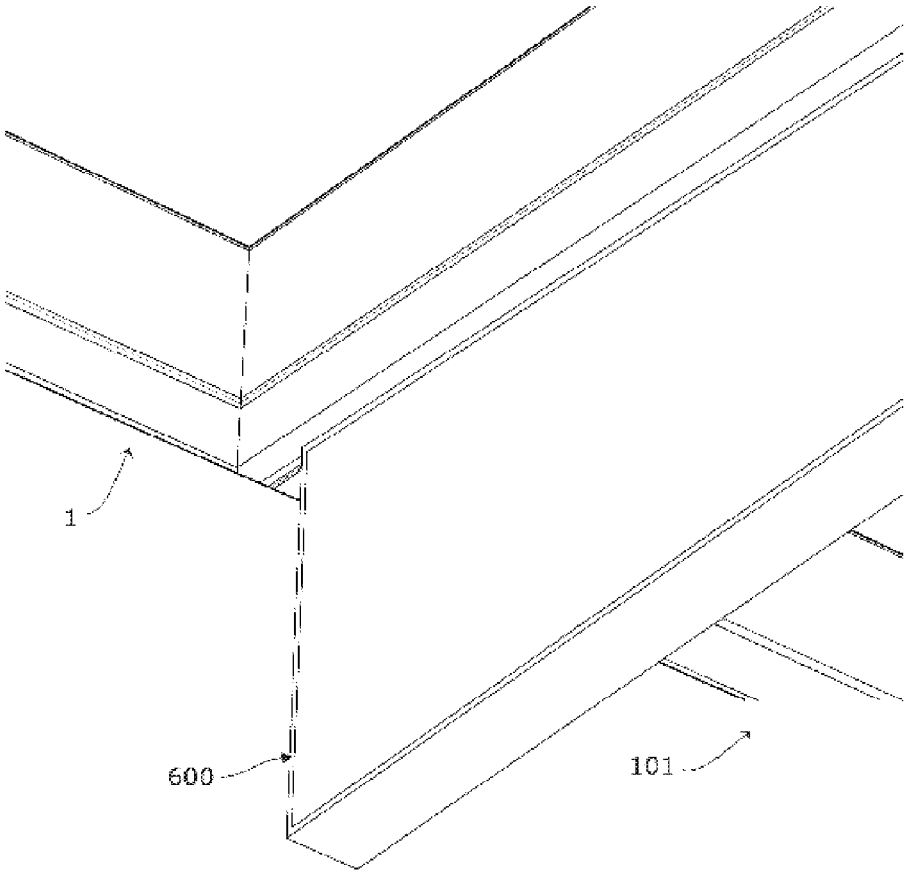
FIG. 6 is a view corresponding to FIG. 2, of a yet further embodiment of the window arrangement according to the invention.

FIG. 6 shows an embodiment of an accessory element in the form of a baffle plate 600. The baffle plate 600 may have acoustic properties, such as noise reducing or dampening, but may also function as a room divider. The baffle plate 600 may be supplemented by portions extending perpendicularly to the plate to form horizontal surfaces to give the impression of an inner ceiling.

Further alternative accessory elements not shown are conceivable as well, including accessory elements providing a colouring or textural effect, but also to provide screening of the neighbouring window system or systems, for instance in the form of winglets to be pivoted or rolled out and possibly connected to the track between the next pair of neighbouring window systems.

Referring first to FIGS. 7*a* to 10, in which two window systems are built-in side-by-side, the connection between the accessory element(s) and the track formed by the window systems will be described in some detail. Of the left-hand window system is shown the right-hand frame member 3 of the frame structure 1, the right-hand sash member 13 and the pane element 21. To the right of the left-hand window system, there is a further window system, of which the left-hand frame member 105 of the frame structure 101 and sash member 115 are shown. The sash member 115 carries the pane element 121 together with other sash members. Further elements may be included as well as described in Applicant's above-mentioned EP patent application.

The members of the frame and sash structures may in principle be formed in any suitable manner, but may preferably be formed as thin-walled profiles, such as fibre glass reinforced profiles made by pultrusion. Details of such profiles and in particular the fastening of the pane elements 21, 121 by means of glazing lists are described in further detail in Applicants' European patent application under No. EP10197260.2.

In the embodiment shown, the wall thickness of the profiles constituting the frame structure 1, 101 is approximately 3 mm, but the thickness may vary.

To form the track generally designated 100, a groove 50, 150 of each side frame member is formed by a first protruding flange portion 51, 151 extending into a free edge, a second flange portion 52, 152 and a bridging portion 53, 153 between the first and the second flange portions.

In the embodiment shown, the opening into the track 100 is thus provided by the space between the free edges of the first protruding flange portions 51, 151 of juxtaposed side frame members of the frame structures 1, 101. The space defines a first distance between the free edges lying in the range 5 to 30 mm, in the embodiment shown approximately 10 mm. A second distance is defined inside the track between the bridging portions 53, 153 of juxtaposed side frame members lying in the range 10 to 50 mm, here approximately 20 mm. In order to secure a proper retention of the accessory member and/or the connecting device in the track 100, the second distance should exceed the first distance by at least 5 mm.

Although not shown, the accessory element or elements may be connected to the window systems directly, but connection between the at least one accessory element and the window systems is preferably provided by means of a connecting device. The connecting device may be integrated with the accessory element, but also form a separate device to be connected to the accessory element as will be described in further detail below. As a further, but not preferred and not shown possibility, the accessory element may be positioned in the track by opening up the track at one end of the frame structures of the neighbouring window systems.

In FIG. 7*b*, one embodiment of the connecting device is shown as a separate substantially T-shaped element 70 adapted to be connected to the track 100 and connected to the at least one accessory element. The T-shaped element 70 comprises an upper portion 71 received in the track 100 and a lower portion 72 formed as a ratchet to allow engagement with corresponding means on the accessory element by pushing the accessory element upwards on the T-shaped element 70. In order to introduce the T-shaped element 70 into the track, the upper portion is provided with a first dimension not exceeding the first distance between the free edges of the first flange portions 51, 151 and a second dimension exceeding the first distance but not exceeding the second distance between the bridging portions 53, 153. In case the upper portion 71 is made from a non-elastic material, the dimensions should be such that the upper portion 71 may be rotated in the track 100.

In FIG. 9, an alternative connecting device is shown in the form of a substantially needle-shaped element 90. The needle-shaped element 90 is introduced into the track 100 by squeezing legs 91 of the needle-shaped elements towards each other to allow feet 92 to rest on the inner side of the respective first flange portion 51, 151. The accessory element of choice is then connected to head 93 of the needle-shaped element 90.

Referring now in particular to FIGS. 8*a*, 8*b* and 10, which show preferred embodiments of the connecting device, it appears that the connecting device generally designated 80 comprises a plate portion 81 and a protruding engagement portion 82 having a first dimension not exceeding the first distance between the free edges of the first protruding portions 51, 151 and a second dimension exceeding the first distance but not exceeding the second distance between the bridging portions 53, 153. The connecting device 80 may comprise means (not shown) to position the protruding engagement portion 82 in the track 100, i.e. a notch to rotate the connecting device 80 such that the engagement portion 82 is moved from a position, in which it may be introduced into the track 100 to a position in which the larger dimension of the engagement portion 82 rests on the inner sides of the first flanges 51, 151. The first and second dimensions should be chosen such that the connecting device 80 may be inserted and subsequently rotated in the track, but still ensure a proper retention in the track 100. In this position, it is also possible to lock the connecting device 80 to prevent inadvertent removal. This locking may be carried out in any suitable manner, for instance by a locking screw 85. In the embodiment shown, reference is made to the accessory element 400 shown and described in connection with FIG. 4, but the principle refers to any kind of accessory element.

The plate portion 81 in turn comprises engagement means to engage with the accessory element. In its simplest form shown in FIGS. 8*a* and 8*b*, the plate portion 81 is provided with depending hook portions 83 to engage with corresponding hook portions formed in a stepped portion 483 on the accessory element 400.

In a more developed form, the plate portion 81 of the connecting device 80 shown in FIG. 10 is provided with a set of spring-biased hook elements 84. The connection and release, respectively, of the accessory element 400 to the connecting device 80 and thus in turn to the track 100 is best described in connection with FIGS. 12*a*-12*e*. In FIG. 12*a*, the accessory element 400 is hooked onto the left-hand spring-biased hook 84 by its stepped portion 483 as indicated by arrow A. Subsequently, the accessory element 400 is moved upwards in the direction of arrow B as shown in FIG. 12*b*, and the corresponding stepped portion 483 on the right-hand side is brought into engagement with the right-hand spring-biased hook 84 to attain the position shown in FIG. 12*c* (corresponding to FIG. 10). In order to dismount the accessory element 400 from the connecting device 80 and thus the track 100 formed by the neighbouring window systems represented by the frame structures 1, 101, the accessory member is pushed in the direction of arrow D (if present, following removal or loosening of locking screw) to push the right-hand side hook inwards and subsequently pull the accessory element 400 in the direction of arrow E to release the engagement between the hook 84 and the stepped portion 483 in the left-hand side.

FIG. 11 shows a possible design of an accessory element having a removable portion, for instance the same as the transparent section 401, in order to provide access to the interior of the accessory element 400, for instance in order to exchange parts such as a fluorescent tube.

From FIGS. 10 and 11 emerges a feature providing a particularly pleasant appearance, viz. the double shadow grooves 250 provided by the transition between the side frame member 3 and the side sash member 13 on one hand, and the transition 350 between the lower edge of the side frame member 3 and the accessory member 400, i.e in the embodiment shown at the stepped portion 483, resulting in a visually uniform surface with parallel lines constituted by the double shadow grooved 250 and the transition 350.

The invention should not be regarded as being limited to the embodiments shown in the drawings and described in the above. Various modifications and combinations may be carried out within the scope of the appended claims.

The invention claimed is:

1. A window arrangement comprising:

a plurality of neighbouring window systems, each window system comprising at least a frame structure including a plurality of frame members including a pair of opposed side frame members, a sash structure carrying a pane element and including a plurality of sash members, and at least one accessory element, each side frame member of said pair of opposed side frame members comprises at least one groove formed by a first protruding flange portion extending into a free edge, a second flange portion and a bridging portion between the first and the second flange portions, and wherein the at least one groove of each side frame member is provided in a face of the side frame member facing away from the pane element, such that two grooves of juxtaposed side frame members of two neighbouring window systems form a track, first and second spring biased hooks for detachably connecting the at least one accessory element to the window systems, a first support shaft for rotatably supporting said first spring biased hook and a second support shaft for rotatably supporting said second spring biased hook; and, a connecting device connecting said first and second spring biased hooks to the window systems and the connecting device being adapted to be received in the track and connected to the at least one accessory element by said first and second spring biased hooks wherein the first and second support shafts are attached to the connecting device and the first and second spring biased hooks are rotatably attached to the connecting device.

2. A window arrangement according to claim 1, wherein a first distance between the free edges of the first protruding flange portions of juxtaposed side frame members lies in the range 5 to 30 mm, and a second distance between the bridging portions of juxtaposed side frame members lies in the range 10 to 50 mm, the second distance exceeding the first distance by at least 5 mm.

3. A window arrangement according to claim 2, wherein the accessory element is selected from the group: profiles comprising smoke sensors, profiles comprising lighting elements, profiles comprising ventilation devices, profiles comprising temperature measurement means, profiles comprising moisture measurement means and lighting devices.

4. A window arrangement according to claim 1, wherein the connecting device includes a substantially T-shaped section.

5. A window arrangement according to claim 1, wherein the connecting device comprises a plate portion and a protruding engagement portion having a first dimension not exceeding a first distance and a second dimension exceeding the first distance but not exceeding a second distance wherein the first distance is the distance between the free edges of the first protruding flange portions of juxtaposed side frame members and the second distance is the distance between the bridging portions of juxtaposed side frame members.

6. A window arrangement according to claim 5, wherein said first and second spring biased hooks are attached to the plate portion.

7. A window arrangement according to claim 1, wherein each accessory element of the window arrangement comprises a uniform profile shape, and wherein a functionality is built into at least two of the accessory elements due to construction of the at least two of the accessory elements.

8. A window arrangement according to claim 1, wherein the connecting device includes a substantially T-shaped section.

9. A window arrangement according to claim 8, wherein the connecting device comprises a plate portion and a protruding engagement portion having a first dimension not exceeding a first distance and a second dimension exceeding the first distance but not exceeding a second distance wherein the first distance is the distance between the free edges of the first protruding portions of juxtaposed side frame members and the second distance is the distance between the bridging portions of juxtaposed side frame members.

10. A window arrangement according to claim 9, wherein said connecting device is configured to be retained by the track by orienting said connecting device in a first position where said protruding engagement portion can be inserted into the track and when the said protruding engagement portion is positioned in the track rotating the connecting device to a second position where the connecting device is retained by the track.

11. A window arrangement according to claim 1, wherein said connecting device is configured to be retained by the track by orienting said connecting device in a first position where a portion of the connecting device can be inserted into the track and when the portion of the connecting device is positioned in the track rotating the connecting device to a second position where the connecting device is retained by the track.

12. A window arrangement according to claim 11, wherein the accessory element is selected from the group: profiles comprising smoke sensors, profiles comprising lighting elements, profiles comprising ventilation devices, profiles comprising temperature measurement means, profiles comprising moisture measurement means and lighting devices.

13. A window arrangement according to claim 1, wherein the accessory element is selected from the group: profiles comprising smoke sensors, profiles comprising lighting elements, profiles comprising ventilation devices, profiles comprising temperature measurement means, profiles comprising moisture measurement means and lighting devices.

* * * * *